US006536152B1

(12) United States Patent
Wisz

(10) Patent No.: US 6,536,152 B1
(45) Date of Patent: Mar. 25, 2003

(54) STORAGE COMPARTMENT FORMING INSERT FOR A FIREARM GRIP

(76) Inventor: David L. Wisz, 5906 Creekside, Troy, MI (US) 48098

( * ) Notice: Subject to any disclaimer, the term of this patent is extended or adjusted under 35 U.S.C. 154(b) by 0 days.

(21) Appl. No.: 10/134,778

(22) Filed: Apr. 29, 2002

(51) Int. Cl.[7] ..... F41C 23/22

(52) U.S. Cl. ..... 42/71.01; 42/71.02; 42/6; 42/90; 42/95; 42/96; 42/1.02; 42/85; 42/106; 42/49.01; 42/49.02

(58) Field of Search ..... 42/71.01, 71.02, 42/6, 90, 95, 96, 1.02, 49.01, 49.02, 106, 85

(56) References Cited

U.S. PATENT DOCUMENTS

| | | | | | |
|---|---|---|---|---|---|
| 151,882 | A | * | 6/1874 | Jones | 42/59 |
| 2,484,168 | A | * | 10/1949 | Jachimiec | 42/71.01 |
| 2,509,553 | A | * | 5/1950 | Wylie | 42/71.02 |
| 3,618,248 | A | * | 11/1971 | Into et al. | 42/71.01 |
| 4,276,807 | A | * | 7/1981 | Whitlock | 89/37.04 |
| 4,697,367 | A | * | 10/1987 | Brophy | 42/71.01 |
| 4,697,368 | A | * | 10/1987 | Williams | 42/59 |
| 4,970,819 | A | * | 11/1990 | Mayhak | 42/70.01 |
| 5,048,213 | A | * | 9/1991 | Gerhard | 42/71.01 |
| 5,048,215 | A | * | 9/1991 | Davis | 42/72 |
| 5,068,991 | A | * | 12/1991 | Reed | 42/71.01 |
| 5,159,136 | A | * | 10/1992 | Marsh | 42/71.01 |
| 5,225,613 | A | * | 7/1993 | Claridge | 42/74 |
| 5,813,157 | A | * | 9/1998 | Scott et al. | 42/71.01 |
| 6,012,246 | A | * | 1/2000 | Robinson et al. | 42/71.01 |
| 6,173,519 | B1 | | 1/2001 | Garrett | |
| 6,230,430 | B1 | * | 5/2001 | Gosselin | 42/90 |
| 6,301,817 | B1 | * | 10/2001 | Hogue et al. | 42/71.01 |
| 6,389,729 | B2 | * | 5/2002 | Rauch et al. | 42/71.01 |

FOREIGN PATENT DOCUMENTS

DE 0339602 * 7/1921

OTHER PUBLICATIONS

Bushmaster Firearms, Pistol Grip Plug, web page.
Bushmaster Firearms, M16A2 Stowaway Grip, web page.
Bushmaster Firearms, Stowaway Grip, Bolt and Field Repair Kit web page.
Mumma, Jr., Sgt. Nelson, Special Operations Improves M4 Carbine, Army Link News, Sep. 1998.
Mounted Accessories, web page.
Possible Configurations, web page.
SOPMOD M4 Accessory Kit.

* cited by examiner

*Primary Examiner*—Michael J. Carone
*Assistant Examiner*—John Richardson

(57) ABSTRACT

A storage compartment forming insert fits within the hollow compartment of a firearm grip assembly to create a storage compartment. The insert generally includes a base and a resilient member extending therefrom. The base defines an outer dimension that provides an interference fit within the hollow compartment. By maintaining the base under tension at the interference fit, the storage compartment is effectively impervious to water. To insert or remove objects within the storage compartment, one need only pull the base. The resilient members stretch and the open end of the grip becomes accessible.

27 Claims, 4 Drawing Sheets

STORAGE COMPARTMENT FORMING INSERT FOR A FIREARM GRIP

BACKGROUND OF THE INVENTION

The present invention relates to a grip assembly, and more particularly to an insert for a firearm grip which forms a storage compartment therein.

Firearms commonly have a dedicated storage compartment in the stock for small items such as spare parts, cleaning supplies, extra batteries or the like. With the increasing prevalence of smaller carbine type firearm designs, the fixed stock is commonly replaced by a folding or telescoping stock. One exemplary firearm of this type is the M4 carbine which has a telescopic stock. The telescopic stock replaces the fixed stock of the M-16 series firearms and eliminates the dedicated storage compartment.

Firearms without a fixed stock commonly include one or more pistol grips. These grips often provide hollow cavities which are otherwise open and afford the potential for conversion to storage spaces.

One such device is a grip assembly which completely replaces the original grip. The grip assembly provides a latched hatch which pivots open to reveal a storage space. The hatch is latched and unlatched by manipulation of a flexible barb. The barb is recessed in an attempt to prevent inadvertent opening from contact with external objects such as brush and tree branches. However, the recessed engagement typically requires a small pointed object such as a bullet to successfully open the hatch. The storage space may therefore be difficult to readily access. Incorporation of the pivoting hatch also results in a storage grip that is larger than the original which may result in reduced firearm handling qualities for some individual operators. The storage grip is also not waterproof which may limit the type of items carried therein.

Another device is a plug which fits into the bottom of the original grip. The plug includes a radially extending lip which extends for a larger perimeter than the grip hollow compartment to assure that the plug is not inadvertently driven to far into the grip. Due to manufacturing variances, it is difficult to assure a tight yet readily removable fit for the plug. The plug may inadvertently fall out of the grip thereby losing the stored items.

Accordingly, it is desirable to provide a secure storage compartment within the original grip which is readily accessible. It is further desirable that the storage compartment be waterproof and retain high-value or mission critical items in a protected environment.

SUMMARY OF THE INVENTION

The storage compartment forming insert according to the present fits within the hollow compartment of a grip assembly to create a storage compartment. The insert generally includes a base and a resilient member extending therefrom. The base defines an outer dimension which conforms to the inner diameter of the hollow compartment. The outer dimension defines an interference fit with the hollow compartment. A tab assists in gripping the base To assemble the insert into the grip, a grip mounting fastener need only be removed and passed through an opening in each resilient member. The threaded fastener is then mounted into the firearm in a normal manner. Once the treaded fastener is threaded into place, the base is released and the resilient members pull the base into the hollow compartment. The flexibility of the base assures an effective seal with the hollow compartment.

The resilient members are under tension when the base reaches the interference fit within the hollow compartment. By maintaining the base under tension at the interference fit, the storage compartment is effectively impervious to water as the insert seals the open end while the threaded fastener seals the closed end.

To insert or remove items within the storage compartment, one need only grip the tab and pull the base below the open end of the grip. The resilient members provide enough extension to readily access the storage compartment while assuring a tension on the resilient members when the base reaches the interference fit. Stored items are therefore securely retained within the storage compartment without concern that the insert may become loose, fall out, become unlatched, etc. The resilient members also provide a relatively shock-resistant mounting arrangement.

Another insert is manufactured to removably receive a predetermined item such as a pair of batteries, a light bulb, or the like. By specifically forming the base to removably receive a specific predetermined item a secure and rattle-resistant storage is provided. Such specialized storage is particularly useful for high-value or mission critical items.

The present invention therefore provides a secure waterproof storage compartment within the original grip while maintaining ready accessibility to the stored items.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
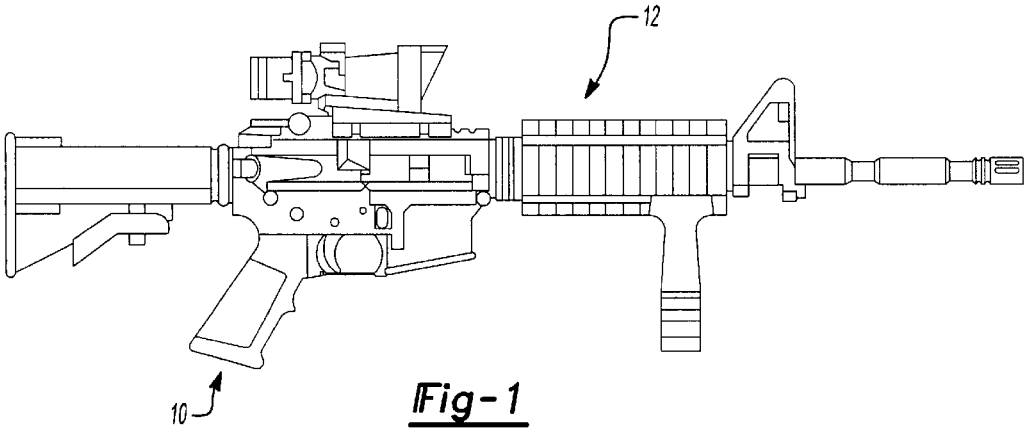
FIG. 1 is a general perspective view an exemplary firearm embodiment for use with the present invention.

FIG. 1 illustrates a general perspective view of a firearm grip assembly 10 mounted to a firearm (illustrated schematically at 12). It should be understood that although a particular firearm is disclosed in the illustrative embodiment, many firearms will benefit from the present invention.

Figure 2:
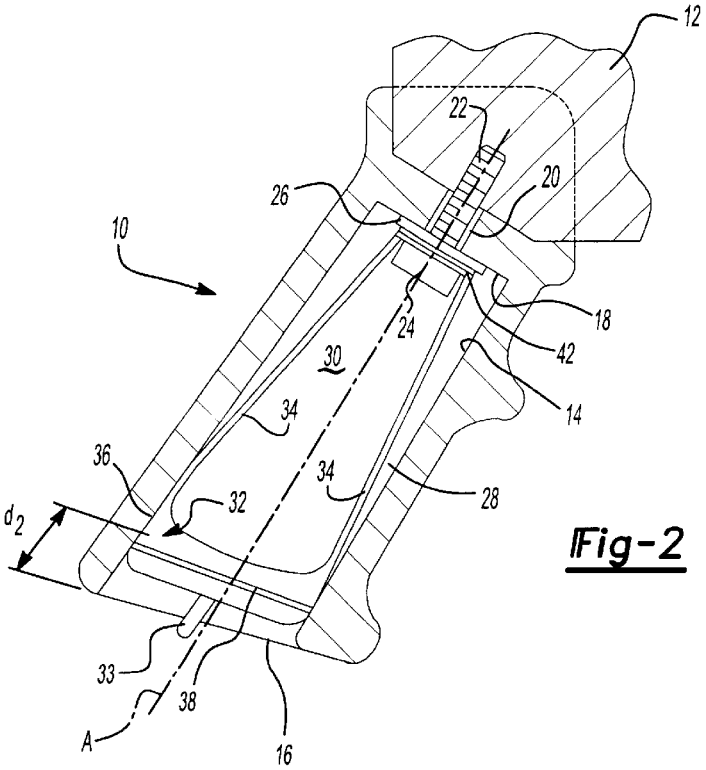
FIG. 2 is a sectional view of a grip assembly having a storage compartment forming insert according to the present invention in a first position.

Referring to FIG. 2, a sectional view of the grip assembly 10 is illustrated. The grip assembly 10 defines a hollow compartment 14 having an open end 16 and a closed end 18. The hollow compartment 14 is typically smaller at the closed end 16 than at the open end 18. The closed end 18 includes an aperture 20 for passage of a threaded fastener 22. The threaded fastener 22 engages complimentary threads on the firearm 12 to mount the grip assembly thereto. The threaded fastener 22 includes a head 24 of a larger outer dimension than the aperture 20. A washer 26 or the like may also be located between the head 24 and the grip assembly 10 to further disperse the force of the head 24 about a larger surface area about aperture 20.

A storage compartment forming insert 28 (also separately illustrated in FIG. 3) of the present invention fits within the hollow compartment 14 to create a storage compartment 30 That is, the insert 28 alters the normally open hollow compartment to a closed compartment. The insert 28 is preferably manufactured of a substantially resilient material such as rubber or the like. The insert 28 generally includes a base 32 and a resilient member 34 extending therefrom. The base 32 defines an axis A which extends substantially along the longitudinal length of the grip assembly 10. Axis A preferably extends along the length of threaded fastener 22. The resilient member 34 is preferably manufactured of the same resilient material as the base, however, the resilient member 34 may alternatively be formed of a material different the base 32.

The base 32 defines an outer dimension 36 which conforms to the inner diameter of the hollow compartment 14. Preferably, the outer dimension 36 defines an interference fit with the hollow compartment 14 at a predetermined distance d inward from the open end 16. That is, the insert 28 fits into the hollow compartment 14 and need not engage the open end 16. The outer dimension 36 may alternatively include a raised rim 37 (FIG. 3) which extends about the base 32 to further increase the assurance of an interference fit.

Figure 3:
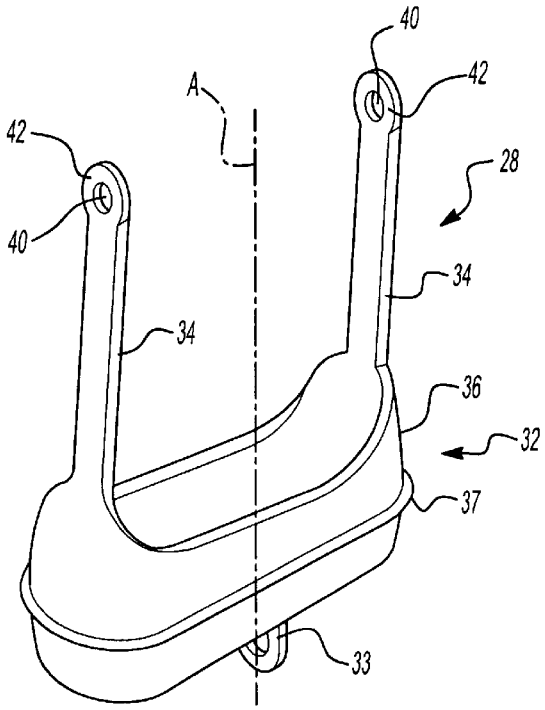
FIG. 3 is a general perspective view of the storage compartment forming insert illustrated in FIG. 2 in a first position.

The base 32 is preferably of a cup-like shape (FIG. 3). The cup-like shape facilitates the interference fit and also assist in retaining small stored items. It should be understood that other shapes will also benefit form the present invention.

An extension 33 assists in gripping the base 32. The extension 33 extends from the base 32 opposite the resilient members 34 and may take many forms and shapes. Preferably, the extension 33 extends slightly below the open end 18 substantial perpendicular to the base 32.

A substantially rigid support 38 (FIG. 2) such as a plastic may alternatively or additionally be molded into or attached to the base 32 to add rigidity to base 22. It should be understood that due to open tolerances common to the grip 10 and insert 28, the predetermined distance may vary widely form part to part. Function, however, is unaffected as the resilient member's 34 create a biasing force which pulls the base 32 to the interference fit.

The resilient members 34 are flexible elongated band-like members which extend from the base 32 substantially parallel to axis A. Preferably, the cup-like base 32 extends smoothly into the resilient members 34. Each resilient member 34 defines an opening 40 at its free end 42. The free end 42 being the end not attached to the base 32. The opening 40 is preferably a loop (FIG. 3) which will receive the threaded fastener 22.

To assemble the insert 28 into the grip 10, the threaded fastener 22 need only be removed and passed through the opening 40 of each resilient member 34. The threaded fastener is then mounted into the firearm 12 in a normal manner. As the resilient members 34 stretch, the base 32 is simply held away form the open end 16 while a tool or the like drives the threaded fastener 22. Once the treaded fastener 22 is threaded into place, the base 32 is released and the resilient members 34 pull the base 32 along axis A and into the hollow compartment 14. The flexibility of the base 32 assures an effective seal within the hollow compartment 14.

The resilient members 34 are preferably under tension when the base 32 reaches the interference fit within the hollow compartment 14 at the predetermined distance d. That is, the interference fit resists the contraction of the resilient members 34 and they are maintained in tension. It should be understood, however, that the base 32 will tightly fit into the hollow cavity 14 even without this tension. In addition, by maintaining the base 32 at the interference fit, the storage compartment 30 is effectively impervious to water as the insert 28 seals the open end 18 while the threaded fastener 22 seals the closed end 16.

Figure 4A:
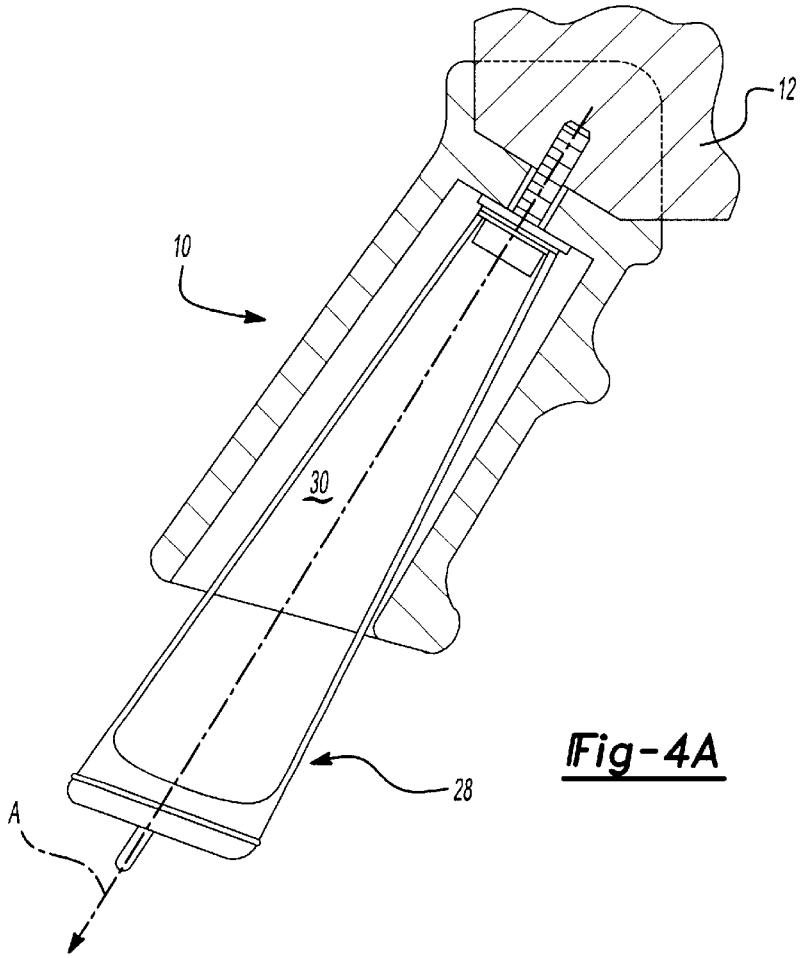
FIG. 4A is a sectional view of a grip assembly having a storage compartment forming insert according to the present invention in a second position.

To insert or remove items within the storage compartment 30, one need only grip the extension 33 and pull the base 32 below the open end 16 (FIG. 4A). The resilient members 34 are preferably manufactured to provide enough extension to readily access the hollow compartment 14. The resilient members 34 are also preferably manufactured to assuring a tension on the resilient members 34 when the base 32 reaches the interference fit predetermined distance d. Objects may therefore be securely retained within the storage compartment without concern that the insert may become loose, fall out, become unlatched, etc. That is, the resilient members 34 provide additional security to the interference fit. The resilient members 34 also provide a relatively shock-resistant mounting arrangement.

Figure 5A:
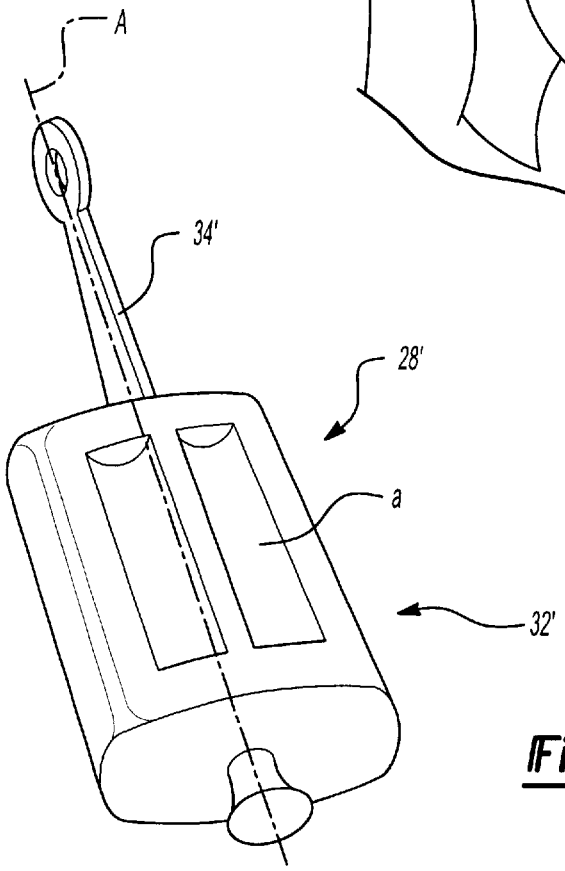
FIG. 5A is a general perspective view of another storage compartment forming insert.

Referring to FIG. 5A, another insert 28' includes a base 32' which is manufactured to securely and removably receive one or more predetermined items A such as batteries, a light bulb, matches, spare ammunition, a spare part firearm part or the like. By specifically forming the base 32' to removably receive the item A, a secure and rattle-resistant storage is provided.

Figure 4B:
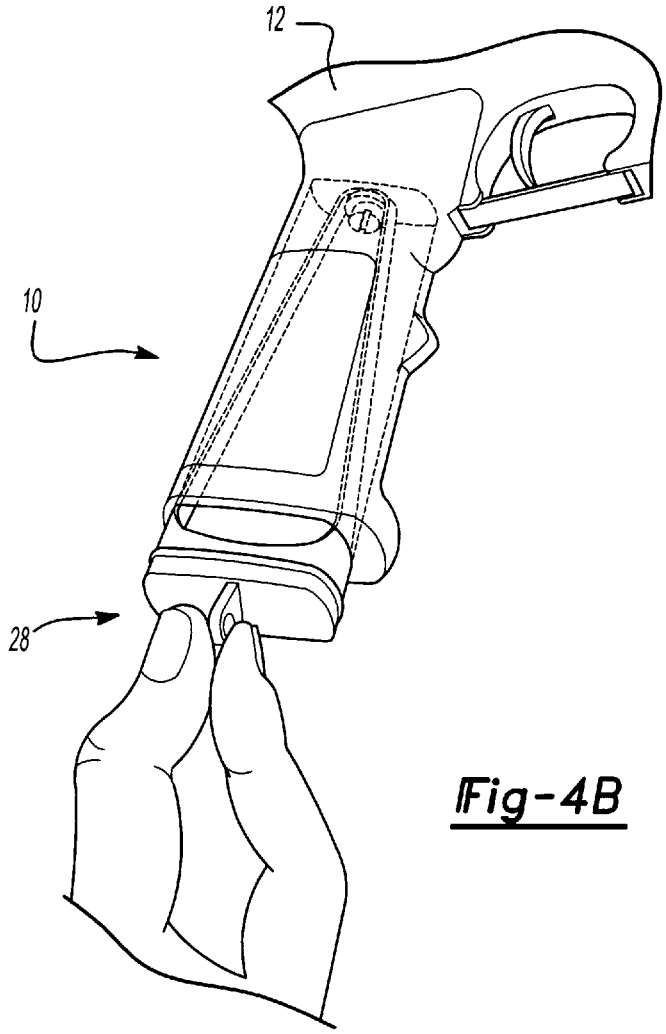
FIG. 4B is a perspective view of a grip assembly having a storage compartment forming insert according to the present invention in a second position.
Figure 5B:
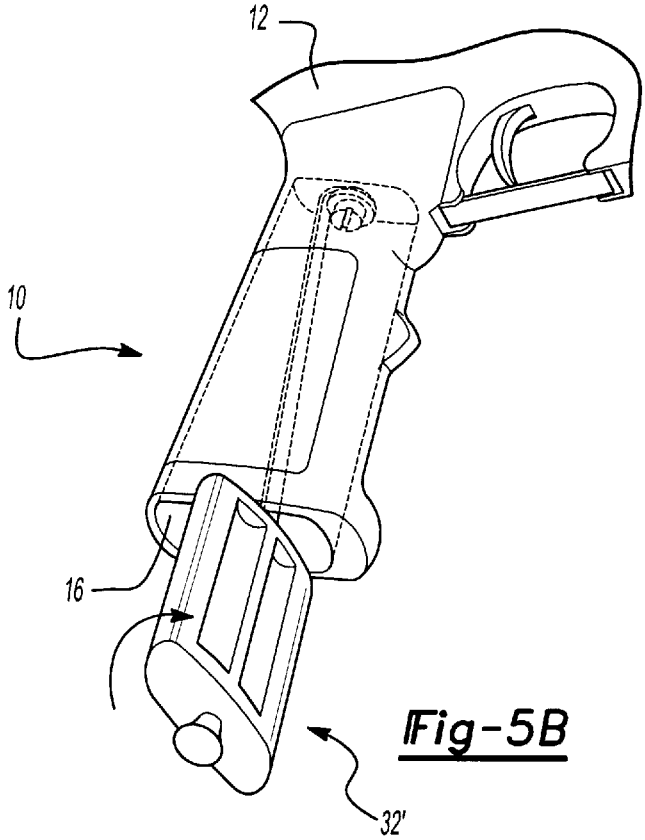
FIG. 5B is a perspective view of the storage compartment forming insert of FIG. 5A in a first poition in which the insert storage compartment is accessible.

Insert 28' includes a single resilient member 34' defined along axis A. The resilient member 34' is preferably a flexible elongated band-like member which extends from a top of the base 32'. The term "top" as defined herein is the end of base 32' which faces the closed end 16 of the hollow compartment 14 when installed in the grip assembly 10. Removal of items is further facilitated by the usage of one resilient member 34' as an operator need only pull the base 32' until the insert 28' extends below the open end 16. The operator then rotates the insert 28 approximately 90 degrees to bridge the open end 16 while the resilient member 34 maintains the insert 28' against the open end 16 (FIG. 5B). Ready access to the items contained therein is therefore provided without maintaining resistance against the resilient member 34 as illustrated in FIG. 4B. Access can also be achieved by simply shifting the insert 28' and hooking an edge of the insert 28' on the open end 16 and allowing the resilient member 34' to maintain the insert 28' against the open end 16.

Preferably, the predetermined item is effectively encased by the insert 28'. That is, only the insert 28' will contact the hollow compartment 14 (FIG. 2) of the grip and not the predetermined item itself. As base 32' provides a larger contact area within the hollow compartment 14 a secure fit is readily assured.

Specialized storage according to the present invention is particularly useful for high-value or mission critical items. Identification devices such as simple "dog-tag" or personal like items may be mounted directly therein. Other identification devices of a more complicated and delicate constructions such as IFF devices may also beneficially utilize the secure waterproof and shock resistant mounting of the present invention.

Figure 5C:
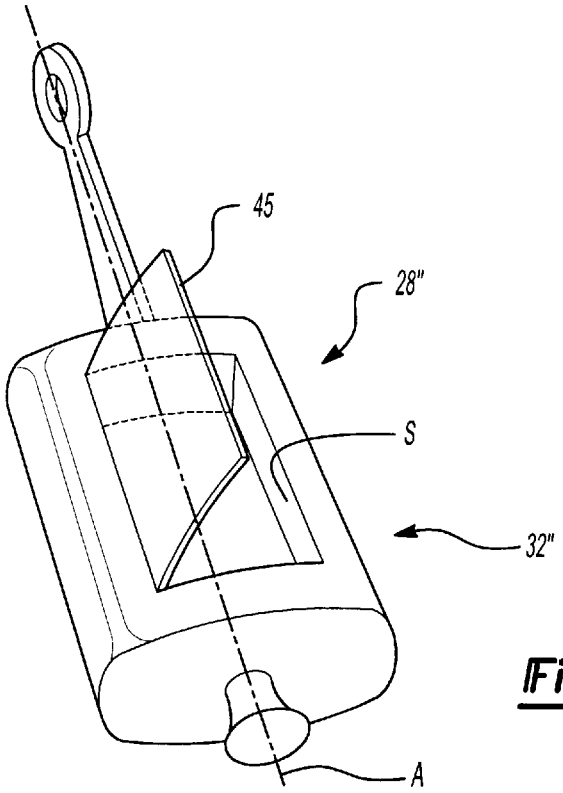
FIG. 5C is a general perspective view of another storage compartment forming insert.

Referring to FIG. 5C, another insert 28" includes a base 32" which includes an insert storage compartment S which is accessed through a flap 45. Insert storage compartment S provides a compartment within the base 32" which is not shaped to receive specific items. Insert storage compartment S Insert storage compartment S operates to directly store items within the insert 28" rather than within the hollow compartment 14 as described above. Insert storage compartment S, moreover, is a generic storage compartment which is not sized to receive predetermined items. The items are secured within the generally waterproof and shock resistant Insert storage compartment S due to being surrounded by the relatively resilient insert 28" within the hollow compartment 14.

Preferably, the flap 45 is integrally formed to extend from a side of the insert 28". The term "side" as used herein is defined by the inner wall of the hollow compartment 14 between the open end 16 and the closed end 18 (FIG. 2). Flap 45 may thereby be manufactured of the same material and as an integral portion of the base 32". It should be understood that the insert may be formed of multiple molded component which are assembled together or may be formed as a single molded component. Alternatively, or in addition, the insert 28" may be manufactured of a relatively rigid hollow component with a resilient over molding layer and resilient member 34".

The flap 45 is simply flexed open. The flap 45 is securely retained in a closed position when the insert 28" is fully within the hollow compartment 14. That is, the fit of the base 32" within tie hollow compartment 14 as described above inherently maintains the flap 45 closed. Such an advantageous arrangement does away with complex hinge and closure mechanisms.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed is:

1. A storage compartment forming insert for a firearm grip defining a hollow compartment comprising:

a base configured to fit into the hollow compartment of the firearm grip, said base defining an axis oriented substantially along a length of the hollow compartment; and a resilient member which extends from said base, said resilient member attachable adjacent a closed end of the hollow compartment to bias said base along said axis toward the closed end.

2. The storage compartment forming insert as recited in claim 1, wherein said base is of a cup-like shape.

3. The storage compartment forming insert as recited in claim 1, further comprising a rigid support mounted within said base.

4. The storage compartment forming insert as recited in claim 1, further comprising a tab which extends from said base opposite said resilient member.

5. The storage compartment forming insert as recited in claim 1, further comprising a loop extending from a free end of said resilient member, said loop receives a grip retention fastener which mounts the firearm grip to a firearm.

6. The storage compartment forming insert as recited in claim 1, wherein said base comprises an insert storage compartment, said insert storage compartment covered by a flexible flap.

7. The storage compartment forming insert as recited in claim 1, wherein said base comprises a raised peripherally extending ridge.

8. The storage compartment forming insert as recited in claim 1, further comprising an interference fit between said base and the hollow compartment to resist said bias.

9. The storage compartment forming insert as recited in claim 1, wherein said base is formed to removably receive a predetermined item.

10. The storage compartment forming insert as recited in claim 9, wherein the predetermined item comprises an identification item.

11. The storage compartment forming insert as recited in claim 1, wherein said resilient member comprises a flexible elongated member.

12. The storage compartment forming insert as recited in claim 1, wherein said resilient member extends from a top of said base.

13. A storage compartment forming insert for a firearm grip defining a hollow compartment comprising:

a base which fits into the hollow compartment of the firearm grip, said base comprising an outer dimension providing an interference fit between said base and the hollow compartment when said base is located a predetermined distance into the hollow compartment, said base containing an insert storage compartment;

a first resilient member which extends from said base, said first resilient member defining a first opening at a free end of said first resilient member; and said free and attached adjacent a closed end of the hollow compartment to bias said base toward the closed end, said first resilient member under tension when said base is located at said predetermined distance.

14. The storage compartment forming insert as recited in claim 13, wherein said insert storage compartment is formed to removably receive a predetermined item.

15. The storage compartment forming insert as recited in claim 13, wherein said base further comprises a flap which operates to cover said insert storage compartment.

16. The storage compartment forming insert as recited in claim 15, wherein said flap is flexibly mounted to said base.

17. The storage compartment forming insert as recited in claim 13, wherein said base defines an axis, said resilient member biases said base along the axis toward the closed end.

18. The storage compartment forming insert as recited in claim 13, wherein said resilient member comprises a flexible elongated member.

19. The storage compartment forming insert as recited in claim 13, wherein said resilient member extends from a top of said base.

20. A firearm grip assembly comprising:

a firearm grip defining a hollow compartment therein;

a threaded fastener which mounts said firearm grip to the firearm, said threaded fastener defining a first axis;

a base which fits into the hollow compartment substantially perpendicular to said first axis, said base comprising an outer dimension providing an interference fit between said base and the hollow compartment when said base is located a predetermined distance along said first axis;

a first resilient member which extends from said base, said first resilient member defining a first opening at a free end of said first resilient member, said first opening engageable with said threaded fastener; and said first resilient member under tension when said base is located at said predetermined distance.

21. The firearm grip assembly as recited in claim 20, wherein said base is formed to removably receive a predetermined item.

22. The firearm grip assembly as recited in claim 20, wherein said first resilient member and a second resilient member form an inverted V-shape relative said threaded fastener.

23. The firearm grip assembly as recited in claim 20, wherein said base comprises an insert storage compartment.

24. The storage compartment forming insert as recited in claim 23, wherein said base further comprises a flap which operates to cover said insert storage compartment.

25. The firearm grip assembly as recited in claim 20, wherein said base defines an axis, said resilient member biases said base along the axis toward the closed end.

26. The firearm grip assembly as recited in claim 25, wherein said resilient member extends substantially parallel to the axis.

27. The firearm grip assembly as recited in claim 20, wherein said first resilient member comprises a flexible elongated member.

* * * * *

UNITED STATES PATENT AND TRADEMARK OFFICE

CERTIFICATE OF CORRECTION

PATENT NO. : 6,536,152 B1
DATED : March 25, 2003
INVENTOR(S) : David L. Wisz

It is certified that error appears in the above-identified patent and that said Letters Patent is hereby corrected as shown below:

Column 6,
Line 42, “and” should be -- end --.

Signed and Sealed this

Eighth Day of July, 2003

JAMES E. ROGAN
*Director of the United States Patent and Trademark Office*